US010066459B2

(12) United States Patent
Antonsen

(10) Patent No.: US 10,066,459 B2
(45) Date of Patent: Sep. 4, 2018

(54) FRACTURING USING RE-OPENABLE SLIDING SLEEVES

(71) Applicant: Roger Antonsen, Houston, TX (US)

(72) Inventor: Roger Antonsen, Houston, TX (US)

(73) Assignee: NOV Completion Tools AS, Stavanger (NO)

( * ) Notice: Subject to any disclaimer, the term of this patent is extended or adjusted under 35 U.S.C. 154(b) by 539 days.

(21) Appl. No.: 13/889,889

(22) Filed: May 8, 2013

(65) Prior Publication Data

US 2014/0332228 A1 Nov. 13, 2014

(51) Int. Cl.

| | |
|---|---|
| ***E21B 43/14*** | (2006.01) |
| ***E21B 34/14*** | (2006.01) |
| ***E21B 43/26*** | (2006.01) |
| ***E21B 47/09*** | (2012.01) |
| *E21B 34/00* | (2006.01) |

(52) U.S. Cl.

CPC ..... *E21B 34/14* (2013.01); *E21B 43/26* (2013.01); *E21B 47/0905* (2013.01); *E21B 2034/007* (2013.01)

(58) Field of Classification Search

CPC ..... E21B 34/00; E21B 34/10; E21B 34/14; E21B 2034/007

See application file for complete search history.

(56) References Cited

U.S. PATENT DOCUMENTS 5,409,061 A * 4/1995 Bullick ..... E21B 34/12 166/205
8,267,178 B1 * 9/2012 Sommers ..... E21B 34/102 166/317
8,739,879 B2 * 6/2014 King ..... E21B 34/103 166/318
8,833,469 B2 * 9/2014 Purkis ..... E21B 33/12 166/250.01
8,893,794 B2 * 11/2014 Patel ..... E21B 34/14 166/177.5
8,931,565 B2 * 1/2015 Desranleau ..... E21B 34/14 166/320
8,991,505 B2 * 3/2015 Fleckenstein ..... E21B 34/063 166/194
9,033,055 B2 * 5/2015 Mccoy ..... E21B 34/14 166/373
9,062,516 B2 * 6/2015 Fripp ..... E21B 34/066
2003/0127227 A1 * 7/2003 Fehr ..... E21B 33/124 166/306
2004/0108116 A1 * 6/2004 McLoughlin ..... E21B 23/006 166/321

(Continued)

OTHER PUBLICATIONS

International Search Report, PCT/US2014/36478, Sep. 4, 2014.
Extended European Search Report for EP 14795253.5 dated Jan. 3, 2017 (9 pages).

*Primary Examiner* — Daniel P Stephenson

(74) *Attorney, Agent, or Firm* — Conley Rose, P.C.

(57) ABSTRACT

Zone isolation is a leading concern for operators that wish to fluidly treat a well. By utilizing a ported sliding sleeve assembly that is highly resistant to leaking after being opened and closed through multiple cycles a wellbore may be accessed at any ported sliding sleeve assembly location without plugging the wellbore below the ported sliding sleeve assembly and will allow any ported sliding sleeve assembly to be accessed in any order.

27 Claims, 12 Drawing Sheets

(56) References Cited

U.S. PATENT DOCUMENTS

| | | | | |
|---|---|---|---|---|
| 2006/0124312 | A1* | 6/2006 | Rytlewski | E21B 23/02 166/313 |
| 2006/0124315 | A1* | 6/2006 | Frazier | E21B 34/06 166/369 |
| 2007/0272411 | A1 | 11/2007 | De Cardenas | |
| 2011/0204273 | A1* | 8/2011 | Braekke | E21B 34/14 251/314 |
| 2012/0211241 | A1* | 8/2012 | Williamson, Jr. | E21B 34/08 166/373 |
| 2013/0233535 | A1* | 9/2013 | Pacey | E21B 34/14 166/206 |
| 2014/0332228 | A1* | 11/2014 | Antonsen | E21B 34/14 166/373 |

* cited by examiner

FRACTURING USING RE-OPENABLE SLIDING SLEEVES

BACKGROUND

In the recovery of downhole hydrocarbons, it is useful to inject fluids or fluid slurries into through the wellbore and to the hydrocarbon bearing formation to fracture or otherwise treat the wellbore or the hydrocarbon bearing formation. Typically, accessing a hydrocarbon bearing formation begins with drilling a wellbore through at least one hydrocarbon bearing zone. After the well is drilled the well is completed by inserting a casing into the wellbore, cementing the casing in the wellbore, and opening ports in the casing through which fluids may be injected into or removed from the formation. Although in some cases the casing is not cemented into the wellbore. In such a case packers may be used for zone isolation.

It may be desirable that a zone of a wellbore adjacent to a targeted hydrocarbon bearing formation be isolated from other zones of the wellbore. For example, if such a targeted zone is not isolated, the fracturing fluid that is pumped down the wellbore, will flow through the ports and then will travel along the exterior of the casing out of the targeted zone into areas that are not hydrocarbon bearing formations and perhaps even into other separate hydrocarbon bearing formations quickly overcoming the ability of the casing to transport the fluid into the formations and the ability of the pumps to supply the fluid at pressure sufficient to fracture the formation. Similarly, annular fluid flow between the wellbore and casing may result in reduced recovery of fluids, loss of treatment fluids, or infiltration of undesired materials into a targeted or untargeted zones.

Usually after a zone has been isolated, ports in the casing may be opened to allow for the injection of fluids or slurries into as well as the removal of fluids or slurries from the hydrocarbon bearing formation. It may be desirable that the ports may be selectively opened or closed. Typically the ports are installed in the well in a closed condition by use of sliding sleeves Typical sliding sleeve valves comprise a sleeve having circumferential seals such as O-rings at the top and bottom edges thereof to seal against a wall of the casing. Thus, when the sleeve is positioned over a port, the sleeve substantially prevents fluid communication between the interior of the casing and the hydrocarbon bearing formation through the port. The port may be opened by moving the sliding sleeve so that the sliding sleeve is located above or below the port or at least aligning a port in the sliding sleeve with the port in the casing thereby allowing fluid flow into or out of the desired zone.

More specifically, a tubular assembly is put together on the rig floor prior to being lowered into the well bore. If the operator does not plan to cement the tubular assembly into the wellbore annular zonal isolation packers will also be installed along the length of the tubular assembly. Typically a packer will be installed both above and below each port and spaced far enough apart to straddle a particular hydrocarbon bearing formation or at least a particular zone of a hydrocarbon bearing formation. In many instances a single packer may serve as the upper packer on one zone as well as the lower packer on an adjacent zone.

The tubular assembly is then lowered into the wellbore so that a port is adjacent to the desired zone, preferably hydrocarbon bearing formation with packers both above and below the zone to straddle the zone.

With the tubular assembly in place the operator then runs an internal packer or plug into the tubular assembly using a second tubular assembly, typically coil tubing. The operator will then land the plug below the lowest port. The plug is then set and the operator disconnects the coil tubing from the plug. Once disconnected from the plug the coil tubing connector is moved up the wellbore and is located adjacent the lowest sliding sleeve where the coil tubing connector latches into the sliding sleeve. The sliding sleeve is then moved from its closed position to its open position. Fluid, typically a hydraulic fracturing slurry, is pumped down the tubular assembly with the tubular assembly plugged below and all of the other sliding sleeves closed the fluid is forced out of the open sliding sleeve port and into the isolated zone. Once the treatment is complete the pumps at the surface are turned off, the operator disconnects the coil tubing connector from the sliding sleeve and lowers the coil tubing and the coil tubing connector to the packer. The packer is then unset and raised until it is above the lowest port and sliding sleeve but below the next higher port and sliding sleeve. The packer is then reset and the process of treating the well is repeated until each zone has been treated. Unfortunately, when a sliding sleeve is opened or closed the seals between the sleeve in the casing are damaged so that thereafter when the sliding sleeve is closed it will leak. Because the sliding sleeves leak when closed after being opened the operator can no longer rely on sliding sleeves to seal for in the event that the operator desired to treat or otherwise service a particular zone.

SUMMARY

A method has been invented which provides for selective communication to a wellbore for fluid treatment while overcoming the limitations of previous zone isolation methods. In one embodiment of the invention the method provides for selective injection of treatment fluids wherein fluid is injected into selected intervals of the wellbore, while other intervals are closed.

In another aspect, the method provides for running in a fluid treatment string, the fluid treatment string having ports substantially closed against the passage of fluid, but when opened permit fluid flow into or out of the wellbore. The methods of the present invention can be used in various borehole conditions including open holes, cased holes, vertical holes, or deviated holes.

In one embodiment a tubular assembly is assembled on the surface incorporating a ported sliding sleeve subassembly as described in U.S. patent application Ser. No. 13/060,300 and invented by Kristoffer Braekke is incorporated by reference herein. The ported sliding sleeve subassembly may be opened and closed as often as desired without substantial leaking. The tubular assembly is then run into the wellbore with each ported sliding sleeve subassembly in the closed position and such that each ported sliding sleeve subassembly is generally adjacent to a desired isolated zone. Zone isolation may be accomplished by cementing the tubular assembly into the well by the use of annular packers along the length of the tubular assembly.

When the operator desires to stimulate or otherwise treat the well a shifting tool is run into the well on coil tubing until the shifting tool is adjacent the desired ported sliding sleeve subassembly. Typically the desired ported sliding sleeve subassembly will be located closest to the bottom of the well. In some instances the shifting tool may be pumped down on wireline or e-line or the shifting tool may be carried down by a tractor. Once the shifting tool is located adjacent to the desired ported sliding sleeve subassembly the shifting tool will latch into a corresponding profile on the sliding sleeve. The shifting tool that ships sliding sleeve open to expose the port. Once the port in the sliding sleeve subassembly is exposed the operator may treat or frac the well through the open ports, without setting an internal packer in the casing although in some instances the operator may desire to set a packer or permanent plug below the lowest ported sliding sleeve subassembly or otherwise seal off the bottom of the casing.

After the formation has been treated through the ported sliding sleeve subassembly the operator may then use the shifting tool to close the ported sliding sleeve subassembly. The operator then disconnects the shifting tool from the ported sliding sleeve subassembly and then proceeds to any other ported sliding sleeve subassembly as desired. In some instances a single ported sliding sleeve subassembly may be used in each isolated zone. However, in other cases multiple ported sliding sleeve subassemblies may be used in a single zone and even other cases a single ported sliding sleeve subassembly may be used in a single zone while multiple ported sliding sleeve subassemblies may be used in another zone all within the same well.

In another embodiment of a wellbore servicing system, a tubular assembly has a first resealable valve and at least a second resealable valve. The first resealable valve has a first profile and the second resealable valve has a second profile. A shifting tool selectively engages the first profile and the second profile and selectively opens or closes the first resealable valve and selectively opens or closes the second resealable valve. The tubular assembly may utilize cement or at least two packers for zonal isolation. In some instances the packers may be swab cup packers or they may be swellable packers. The first resealable valve and the at least second resealable valve may have a substantially cylindrical outer valve housing including radially extending side ports and an inner sliding sleeve mounted axially movable and rotationally locked inside the valve housing. The sliding sleeve may also have a first sealing means, a second sealing means, and a third sealing means. The sealing means are all disposed around the entire circumference of the sliding sleeve and in contact with an inner sealing surface of the valve housing. The axial distance between the first and second sealing means is greater than the length of the valve housing comprising the side ports, and axial distance between the second and third sealing means is greater than the length of the valve housing comprising the side ports. Additionally, the first sealing means is made stiffer than the second and third sealing means and the first sealing means is firmer retained than the second and third sealing means. The sliding sleeve is fixed to a radially flexible latch ring abutting a first inner shoulder on the inner sealing surface of the valve housing when the valve is in a first, closed position, and abutting a second inner shoulder on the inner sealing surface of the valve housing when the valve is in a second, open position axially displaced from the first closed position. The axial force required to move the sliding sleeve between its first and second positions must be sufficient to overcome a radially spring force from the latch ring. The valve typically has a scraping ring disposed between the sliding sleeve and the inner sealing surface of the valve housing. The sliding sleeve typically has a first labeling means where the valve housing is firmly connected to a second labeling means; and the axial distance between the first and second labeling means indicates whether the sliding sleeve opens or closes for the radial side ports.

In another embodiment of the wellbore servicing system, a tubular assembly typically has a first resealable valve and at least a second resealable valve. The first resealable valve may be selectively actuable between an open condition and a closed condition and the at least second resealable valve may be selectively actuable between an open condition and a closed condition. The first resealable valve and the at least second resealable valve in the open condition allow a fluid to flow between an inner diameter of the tubular assembly and an outer diameter of the tubular assembly. The first resealable valve and the at least second resealable valve may be selectively actuable by hydraulic control lines, by an electric motor, or by a shifting tool. In certain instances zonal isolation may be provided by cement or at least two packers. The packers may be swab cup packers, swellable packers, or any other style packer known in the industry. The first resealable valve and the at least second resealable valve may have a substantially cylindrical outer valve housing including radially extending side ports and an inner sliding sleeve mounted axially movable and rotationally locked inside the valve housing. The sliding sleeve may have a first sealing means, a second sealing means, and a third sealing means, which sealing means are all disposed around the entire circumference of the sliding sleeve and in contact with an inner sealing surface of the valve housing. The axial distance between the first and second sealing means is greater than the length of the valve housing having the side ports, and axial distance between the second and third sealing means is greater than the length of the valve housing having the side ports. Typically the first sealing means is made stiffer than the second and third sealing means and the first sealing means is firmer retained than the second and third sealing means. The sliding sleeve is fixed to a radially flexible latch ring abutting a first inner shoulder on the inner sealing surface of the valve housing when the valve is in a first, closed position, and abutting a second inner shoulder on the inner sealing surface of the valve housing when the valve is in a second, open position axially displaced from the first closed position. The axial force required to move the sliding sleeve between its first and second positions must be sufficient to overcome a radially spring force from the latch ring. The valve has a scraping ring disposed between the sliding sleeve and the inner sealing surface of the valve housing. The sliding sleeve may have a first labeling means and the valve housing is firmly connected to a second labeling means. The axial distance between the first and second labeling means indicates whether the sliding sleeve opens or closes for the radial side ports.

In another embodiment for a method of servicing a wellbore. A tubular assembly having a first resealable valve and an at least second resealable valve into a wellbore. The first resealable valve may be selectively actuable between an open condition and a closed condition. The at least second resealable valve may be selectively actuable between an open condition and a closed condition; and where the first resealable valve and the at least second resealable valve in the open condition allow a fluid to flow between an inner diameter of the tubular assembly and an outer diameter of the tubular assembly. Any of the first resealable valve or at least second resealable valve may be selectively actuated from a closed condition to an open condition. The adjacent formation zone is then treated. Any of the first resealable valve or at least second resealable valve may be selectively actuated from an open condition to a closed condition. The first resealable valve may be at least two resealable valves in a single isolated zone. The at least second resealable valves may be at least two resealable valves in a single isolated zone. The first resealable valve and the at least second resealable valve are each selectively actuable by hydraulic control lines, by electric motor, or by a shifting tool. The tubular assembly may utilize cement, or at least two packers for zonal isolation. The packers may be swab cup packers, swellable packers, or any other type packer known in the industry. The first resealable valve and the at least second resealable valve may have a substantially cylindrical outer valve housing including radially extending side ports and an inner sliding sleeve mounted axially movable and rotationally locked inside the valve housing. The sliding sleeve may have a first sealing means, a second sealing means, and a third sealing means. The sealing means are all disposed around the entire circumference of the sliding sleeve and in contact with an inner sealing surface of the valve housing. The axial distance between the first and second sealing means is greater than the length of the valve housing having side ports, and axial distance between the second and third sealing means is greater than the length of the valve housing having side ports. The first sealing means is made stiffer than the second and third sealing means and the first sealing means is firmer retained than the second and third sealing means. The sliding sleeve is fixed to a radially flexible latch ring abutting a first inner shoulder on the inner sealing surface of the valve housing when the valve is in a first, closed position, and abutting a second inner shoulder on the inner sealing surface of the valve housing when the valve is in a second, open position axially displaced from the first closed position. The axial force required to move the sliding sleeve between its first and second positions must be sufficient to overcome a radially spring force from the latch ring. The valve further may also have a scraping ring between the sliding sleeve and the inner sealing surface of the valve housing. In some instances the sliding sleeve may have a first labeling means with the valve housing firmly connected to a second labeling means and where the axial distance between the first and second labeling means indicates whether the sliding sleeve opens or closes for the radial side ports.

DETAILED DESCRIPTION OF THE PRESENT INVENTION

Figure 1:
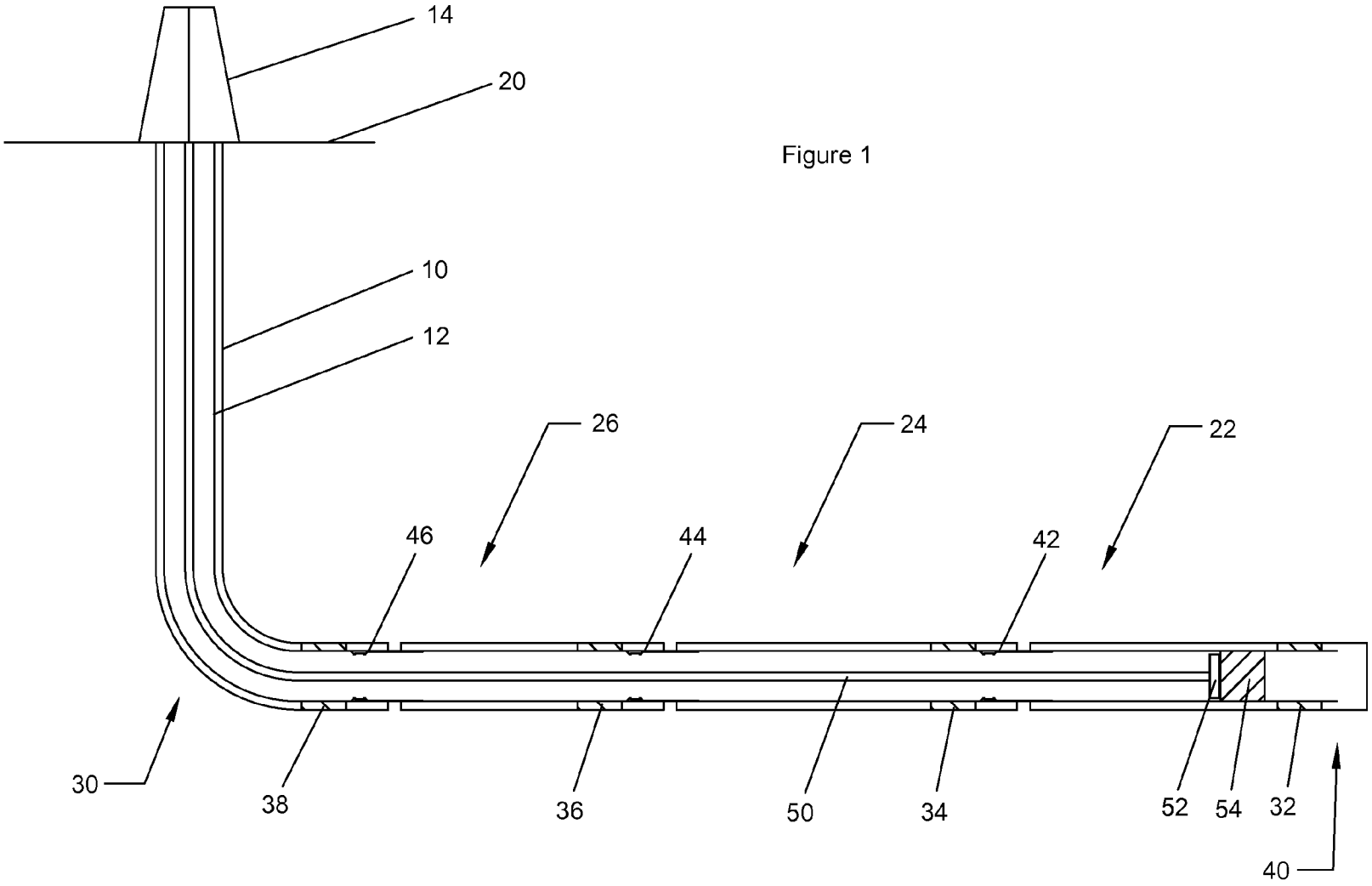
FIG. 1 depicts setting the internal packer in a fracturing process.

Referring to FIG. 1, a wellbore 10 is shown extending vertically from the surface 20 with a heel generally 30 and a toe generally 40. The heel 30 is typically that section of the well where the wellbore 10 transitions from being essentially vertical to being more or less horizontal and extending down to the bottom or lower end of the well 10 at the toe 40. Extending into the well is a tubular assembly 12 is made up on the surface and then run down into the wellbore 10. The tubular assembly 12 typically has along its length external annular packers for zone isolation.

FIG. 1 depicts three formation zones generally 22, 24, and 26. A first packer 32 resides past the lower end of zone 22 while a second packer 34 resides beyond the upper end of formation zone 22. With packers 32 and 34 straddling formation zone 22, formation zone 22 is isolated from both the lower end of the wellbore 10 and formation zone 24. Packer 34 resides past the lower end of formation zone 24 while packer 36 resides beyond the upper end of formation zone 24. With packers 34 and 36 straddling formation zone 24, formation zone 24 is isolated from both formation zone 24 and zone 26. Packer 36 resides past the lower end of formation zone 26 while packer 38 resides beyond the upper end of formation zone 26. With packers 36 and 38 straddling formation zone 26, formation zone 26 is isolated from both formation zone 26 and from the wellbore 10 above packer 38.

The tubular assembly 12 also has sliding sleeves 42, 44, and 46 between the packers 32, 34, 36, and 38 to close off ports in the tubular assembly that would otherwise allow access to the annular area outside the tubular assembly 12 and thus to the formation zones 22, 24, and 26. Any of the packers mentioned herein may be swab cup packers, swellable packers, or any other packer known in the industry. Each port and sliding sleeve may be positioned along the tubular assembly 12 to be approximately adjacent each of the formation zones 22, 24, and 26 when the tubular assembly 12 is properly positioned in the wellbore 10.

Figure 2:
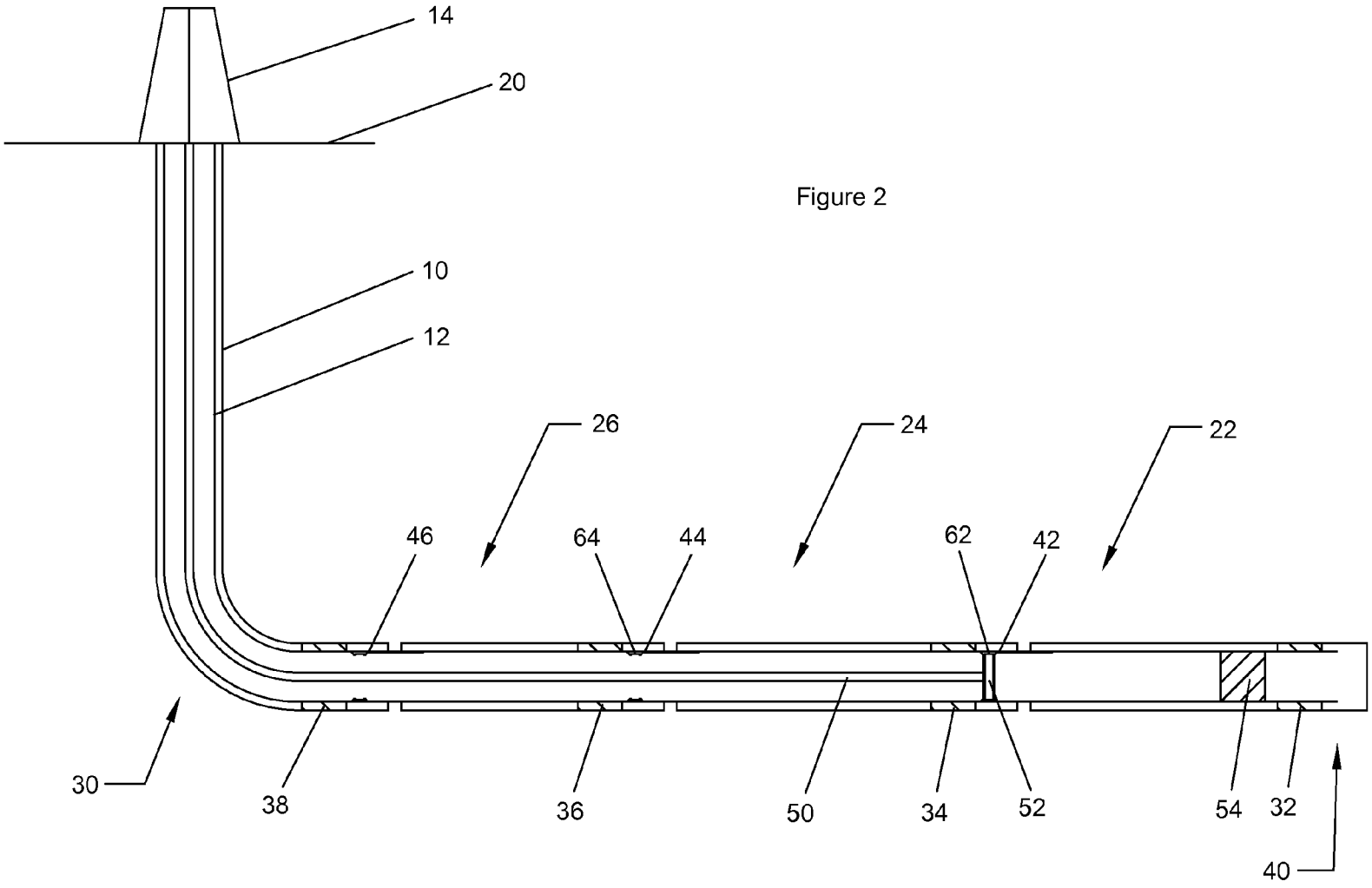
FIG. 2 depicts engaging the sliding sleeve profile in a fracturing process.

FIGS. 1-5 use like reference numerals for like structures. FIG. 2 depicts the first stage in a fracturing operation. With the tubular assembly 12 properly located and secured in wellbore 10, a second tubular assembly typically coil tubing 50 is run into the tubular assembly 12. At the lower end of the coil tubing 50 a disconnect 52 is attached to an internal packer or plug 54. The disconnect 52 will typically consist of a setting tool for setting and releasing packer 54 as well as a profile latch to latch into and release the sliding sleeves 42, 44, and 46. While typically the second tubular assembly is coil tubing any type of tubing could be used. In addition the second tubular assembly could be replaced by slick line or e-line where the disconnect 52 is pumped down the tubular assembly 12 or is carried down the tubular assembly 12 by a tractor or other suitable device.

Once the packer 54 is located in the tubular assembly 12 below sliding sleeve 42 the packer 54 may be set. Once the packer 54 is set, the disconnect 52 is released from the packer 54 and moved uphole until the disconnect 52 is located adjacent profile 62 of sliding sleeve 42. Once disconnect 52 is located adjacent profile 62 of sliding sleeve 42 the disconnect will latch into profile 62. After latching into profile 62 the operator will open sliding sleeve 42.

Figure 3:
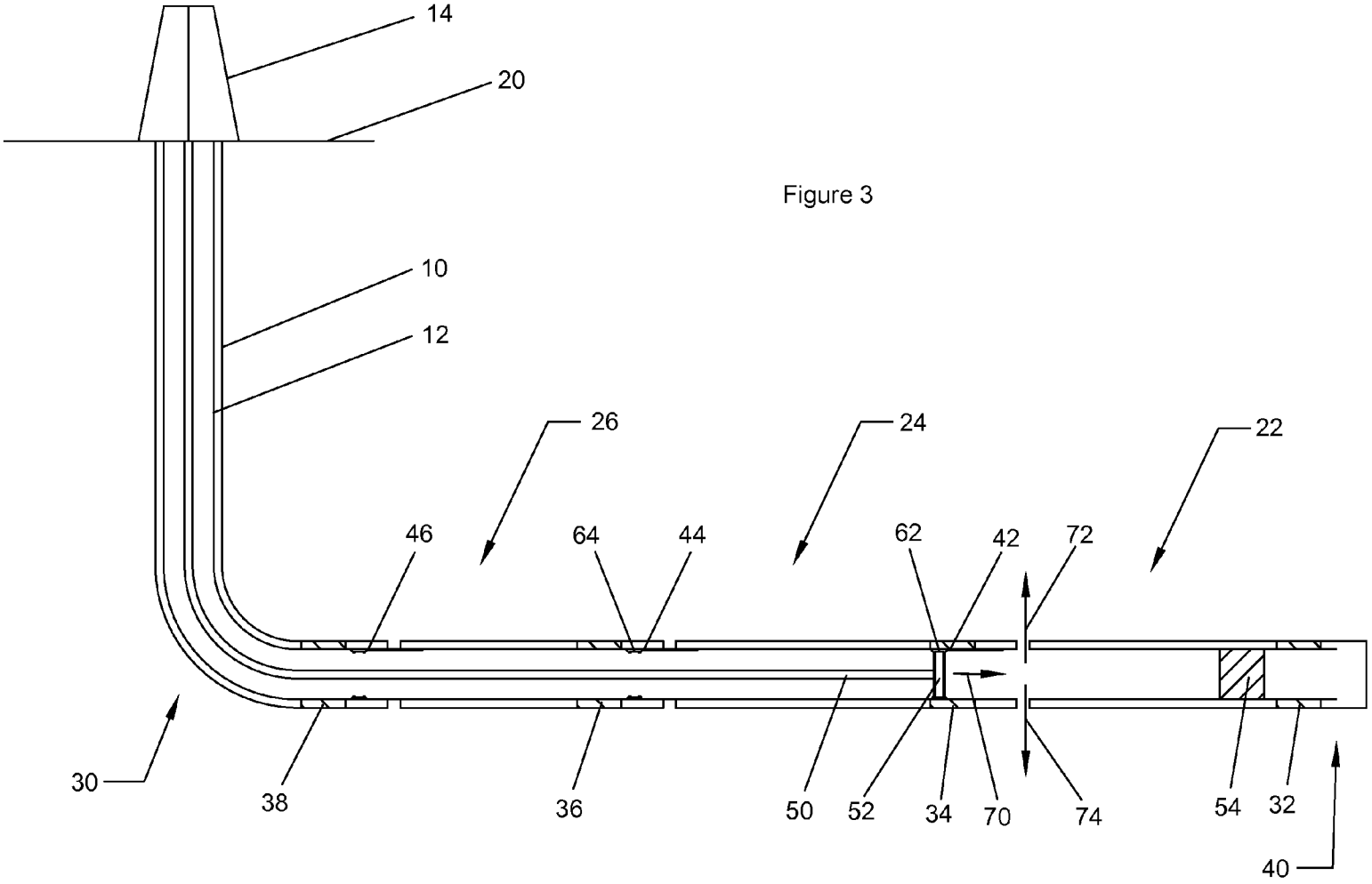
FIG. 3 depicts fracturing is zone in a fracturing process.

FIG. 3 depicts sliding sleeve 42 in its open position allowing fluid to flow through the interior of the tubular assembly 12 as depicted by arrow 70 and out into formation zone 22 as indicated by arrows 72 and 74 to fracture or otherwise treat formation zone 22.

Figure 4:
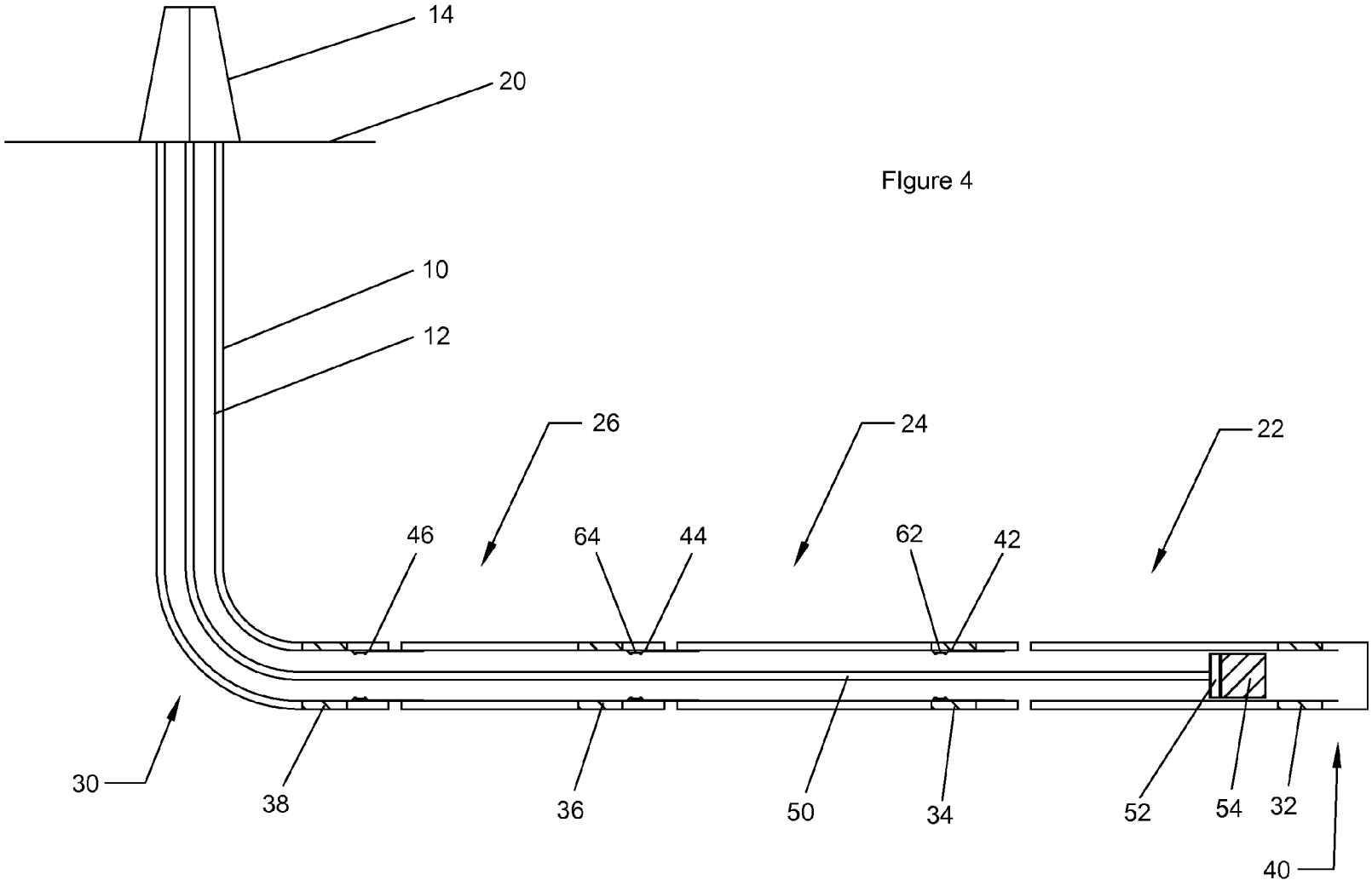
FIG. 4 depicts unsetting the packer in a fracturing process.

As depicted in FIG. 4, once the fracturing operation is complete the pumps at the surface 20 are turned off so that fluid no longer flows out into the formation zone 22. The disconnect 52 is released from profile 62 in sliding sleeve 42. The disconnect 52 is then moved downhole until it re-engages with internal packer 54. The disconnect 52 that releases internal packer 54 from the tubular assembly 12.

Figure 5:
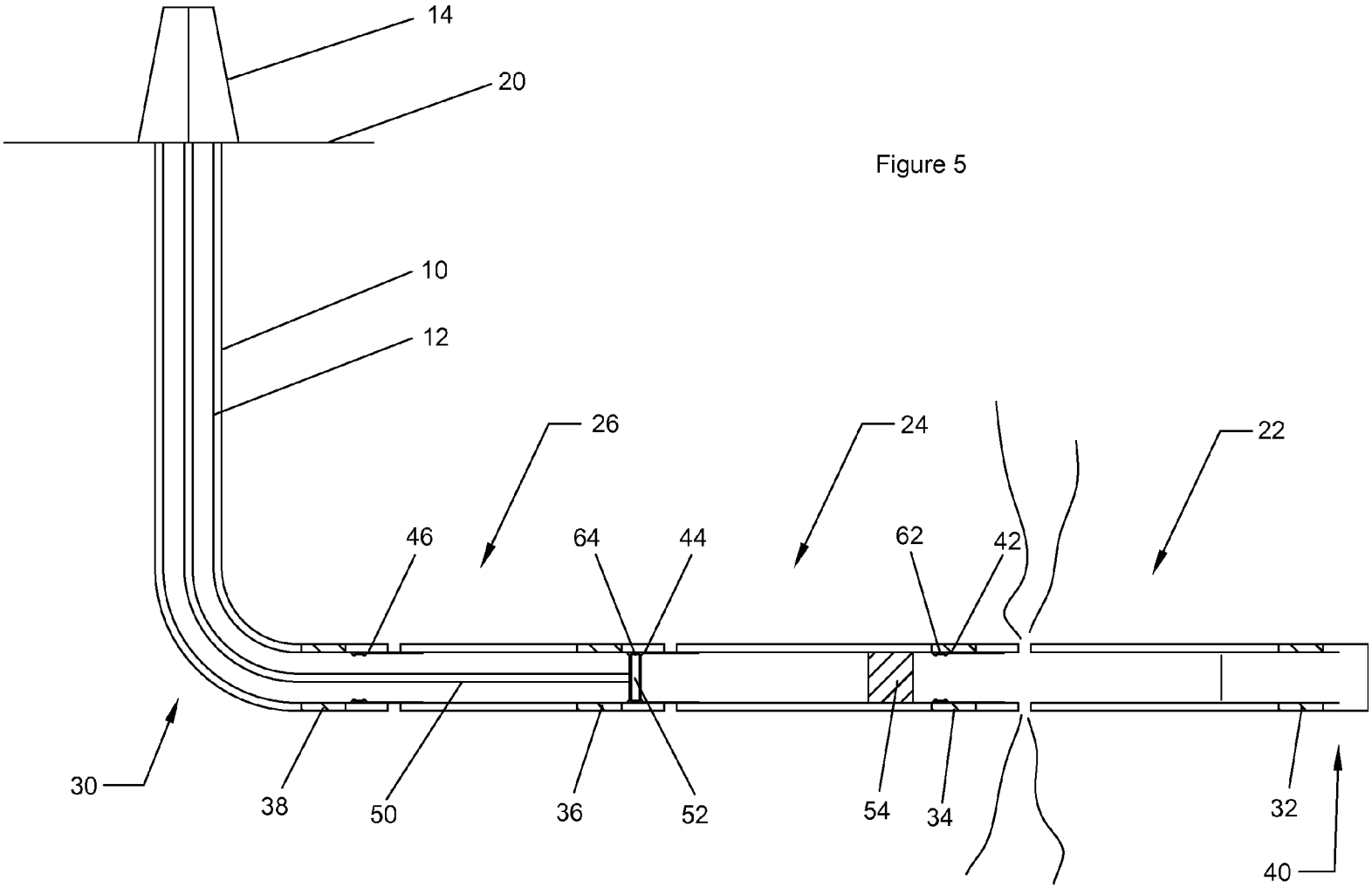
FIG. 5 depicts moving up hole to the next sliding sleeve in a fracturing process.

As depicted in FIG. 5, the coil tubing 50, the disconnect 52, and the internal packer 54 have been moved together to a position above sliding sleeve 42 but below sliding sleeve 44. The packer 54 is then reset in the tubular assembly 12 to block any fluid flow through the internal bore of the tubular assembly 12 past the packer 54. The disconnect 52 is then released from packer 54 and moved upward in the tubular assembly 12 until it is adjacent profile 64 of sliding sleeve 44.

The fracturing process or other treatment of the wellbore 10 continues with the internal packer 54 being set below a sliding sleeve, the disconnect releases the packer 54, moving the disconnect to engage the profile in the sliding sleeve, opening the sliding sleeve, fracturing the formation, releasing the disconnect from the profile in the sliding sleeve, re-engaging the packer, unsetting the packer, moving the packer, and repeating until each sliding sleeve has been opened and each formation zone is treated.

FIG. 6 through 10 depict an embodiment of the present invention utilizing a valve which is a reclosable, leak resistant valve as described in U.S. patent application Ser. No. 13/060,300 and invented by Kristoffer Braekke and is incorporated by reference herein. FIGS. 6-10 use like reference numerals for like structures.

Figure 6:
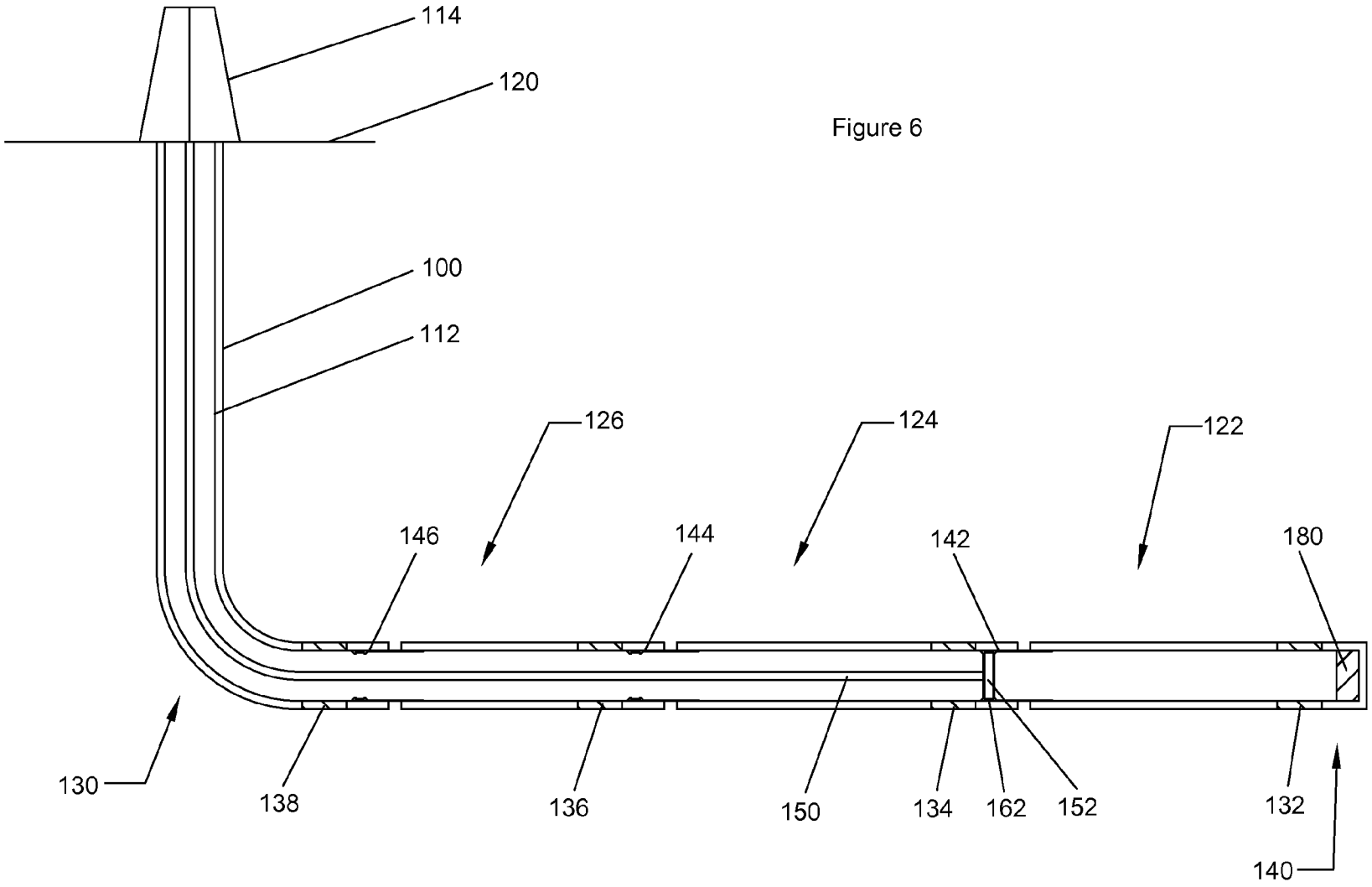
FIG. 6 depicts a tubular assembly having resealable valves.

Referring to FIG. 6, a wellbore 100 is shown extending vertically from the surface 20 with a heel generally 130 and a toe generally 140. The heel 130 is typically that section of the well where the wellbore 100 transitions from being essentially vertical to being more or less horizontal and extending down to the bottom or lower end of the well 100 at the toe 140. Extending into the well is a tubular assembly 112 made up on rig 114 at the surface 120 and then run down into the wellbore 100. The tubular assembly 112 typically has along its length external annular packers for zone isolation.

FIG. 6 depicts three formation zones generally 122, 124, and 126. A first packer 132 resides past the lower end of zone 122 while a second packer 134 resides beyond the upper end of formation zone 122. With packers 132 and 134 straddling formation zone 122, formation zone 122 is isolated from both the lower end of the wellbore 100 and formation zone 124. Packer 134 resides past the lower end of formation zone 124 while packer 136 resides beyond the upper end of formation zone 124. With packers 134 and 136 straddling formation zone 124, formation zone 124 is isolated from both formation zone 124 and zone 126. Packer 136 resides past the lower end of formation zone 126 while packer 138 resides beyond the upper end of formation zone 126. With packers 136 and 138 straddling formation zone 126, formation zone 126 is isolated from both formation zone 126 and from the wellbore 100 above packer 138.

The tubular assembly 112 also has valves 142, 144, and 146 between the packers 132, 134, 136, and 138 to close off ports in the tubular assembly 112 that would otherwise allow access to the annular area outside the tubular assembly 112 and thus to the formation zones 122, 124, and 126. Each port and valve may be positioned along the tubular assembly to be approximately adjacent each of the formation zones 122, 124, and 126. In some instances a float shoe 180 may be placed on the lower end of tubular assembly 112 to prevent fluid from flowing from inside of the tubular assembly 112 through the lower end near the toe of the tubular assembly 140 and into the well 100. The float shoe 180 may be a one-way valve or any other device to prevent fluid from flowing from the inside of the tubular assembly 112 to the outside of the tubular assembly 112.

Figure 7:
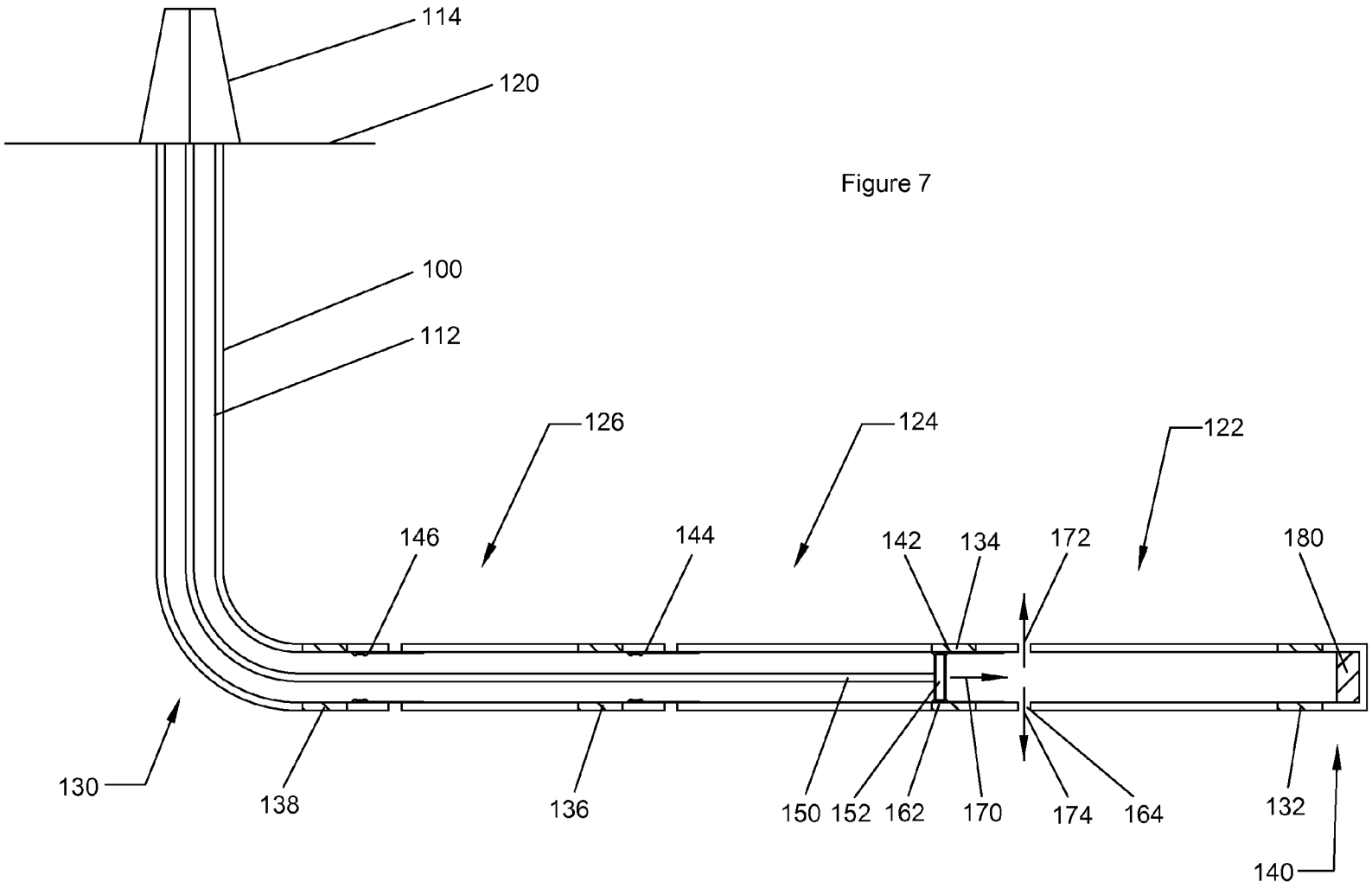
FIG. 7 depicts the tubular assembly with the lowest valve shifted open.

FIG. 7 depicts the tubular assembly 112 with the disconnect 152 latched into profile 162 of valve 142. With the disconnect 152 latched into profile 162 the valve 142 is depicted as having been moved from its closed position to the open position where port 164 is open allowing fluid to flow from the interior of the tubular assembly 112 as depicted by arrow 170 to flow out ports 164 as depicted by arrow's 172 and 174 and into formation zone 122 to fracture or otherwise treat formation zone 122.

Figure 8:
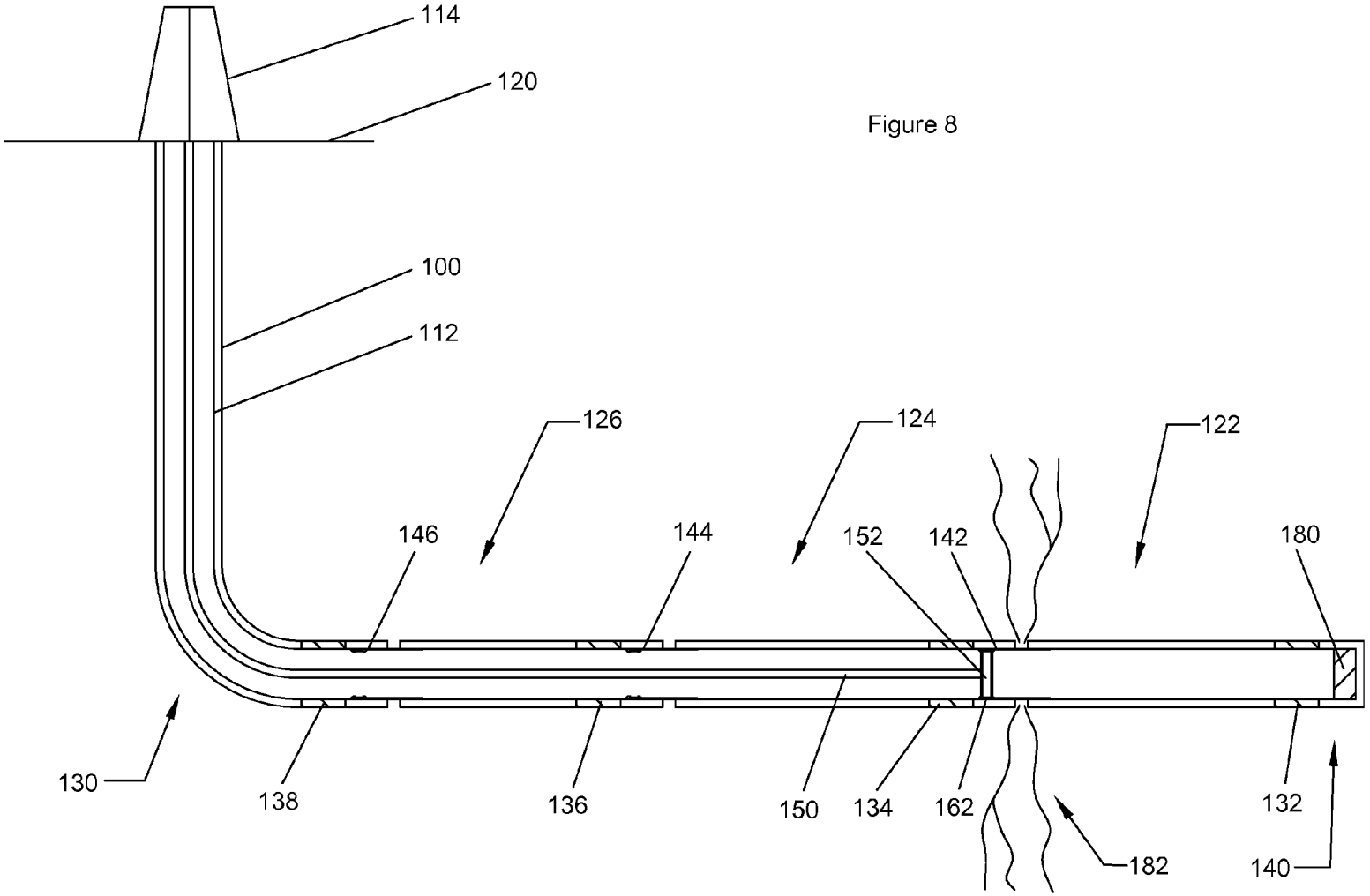
FIG. 8 depicts the tubular assembly with the lowest valve re-sealed.

FIG. 8 depicts the wellbore 100 after formation zone 122 has been treated where the formation zone 122 has fractures 182. The disconnect 162 on the end of coral tubing 150 that is latched into profile 162 of valve 142 is used to close port 164 with valve 142.

Figure 9:
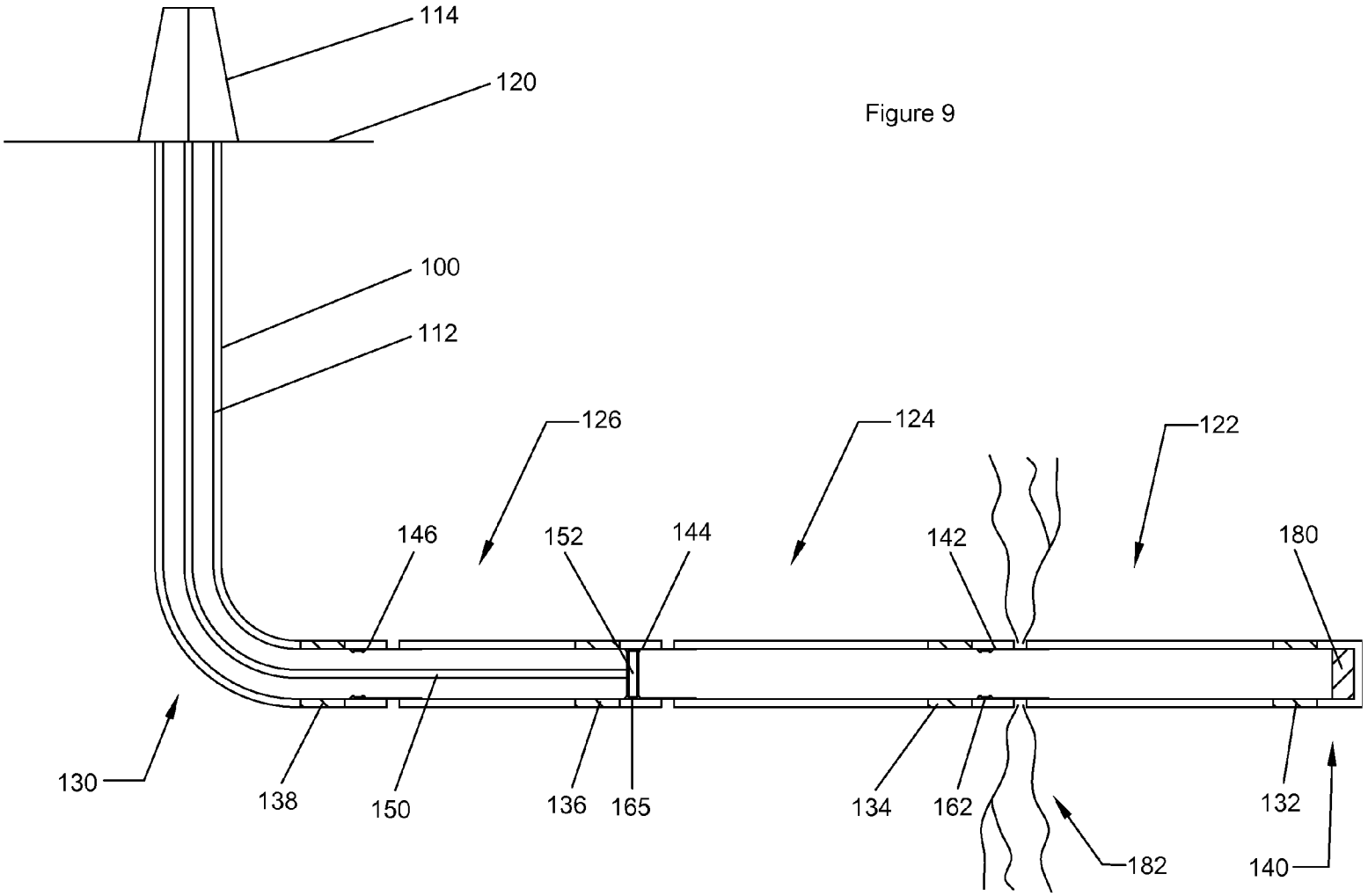
FIG. 9 depicts the tubular assembly with the disconnect at the next desired valve.

As depicted in FIG. 9 the disconnect 152 is released from profile 162 on valve 142 and is moved uphole to engage profile 165 of valve 144.

Figure 10:
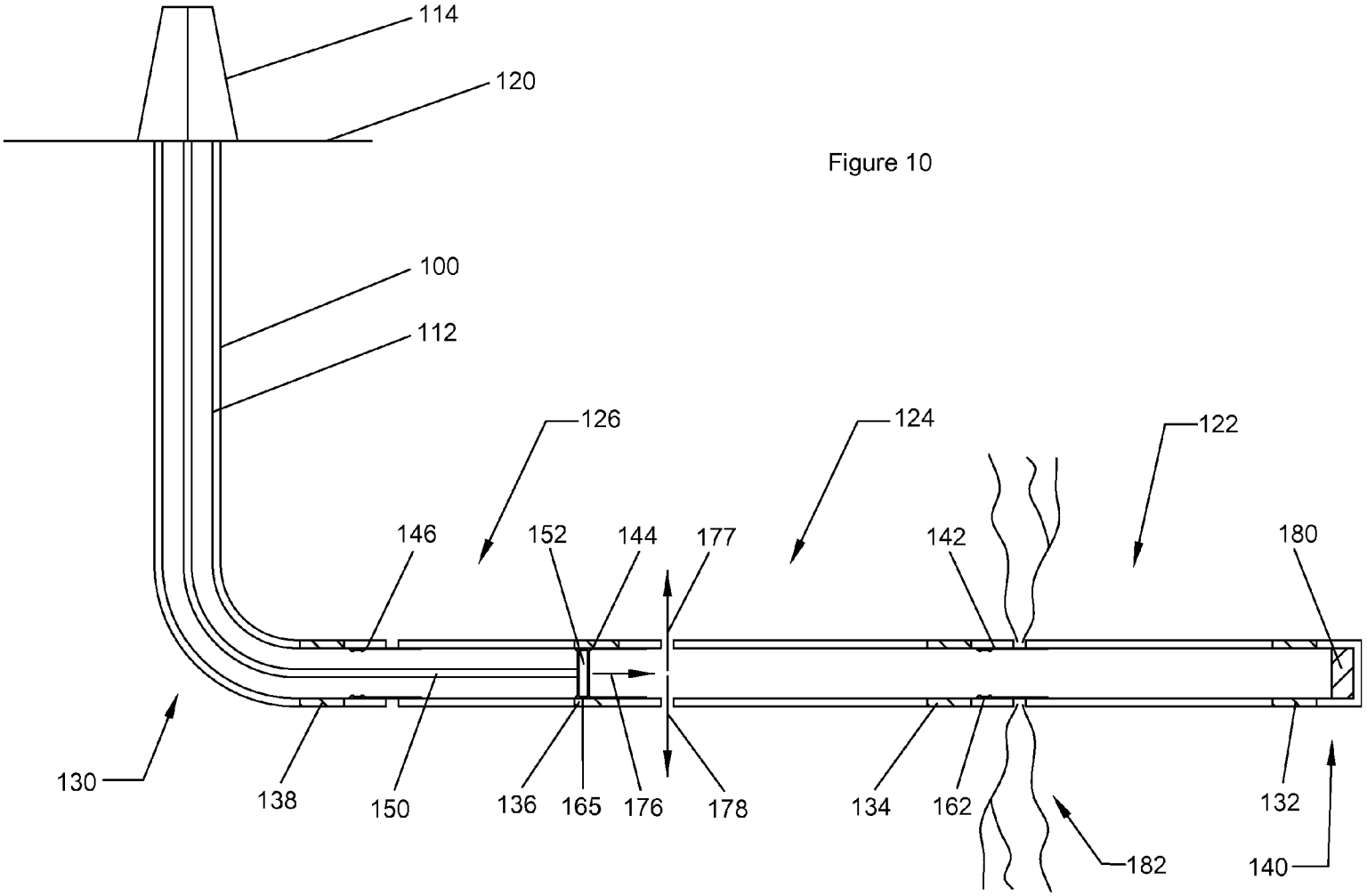
FIG. 10 depicts the tubular assembly with the next desired valve shifted open.

FIG. 10 depicts the disconnect 152 engaged with profile 162 after having shifted the valve 142 from its closed position to the open position where port 166 is open allowing fluid to flow from the interior of the tubular assembly 112 as depicted by arrow 176 to flow out ports 166 as depicted by arrow's.

With the disconnect 152 latched into profile 162 the valve 142 is depicted as having been moved from its closed position to the open position where port 164 is open allowing fluid to flow from the interior of the tubular assembly 112 as depicted by arrow 170 to flow out ports 164 as depicted by arrow's 172 and 174 and into formation zone 122 to fracture or otherwise treat formation zone 122.

The fracturing process or other treatment of the wellbore 100 continues where the disconnect 152 engages the latch on a valve, opens the valve to expose the port, fracturing or otherwise treating the formation zone adjacent the port through the port, closing the valve to seal the port, disengaging the disconnect 152 from the latch on a valve, moving the disconnect until the disconnect is adjacent the next desired valve, and engaging the next desired valve. The process is repeated until each desired valve has been opened and closed and each desired formation zone is treated.

Figure 11:
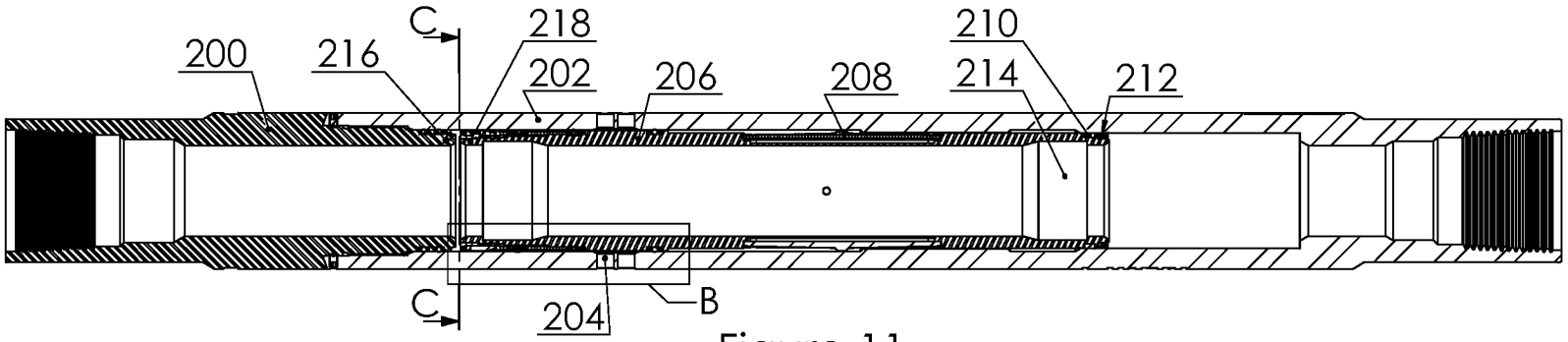
FIG. 11 depicts a cross-section of the valve.

FIG. 11 depicts a longitudinal cross sectional view of a valve utilized in the invention. In FIG. 11, the valve is shown in a closed state. An end part 200 connected to a valve housing 202 form the outer shell of the valve. The valve housing 202 comprises radial side ports 204. An inner sliding sleeve 206 can be moved axially inside the valve housing 202 in order to open or close the radial side ports. As can be best seen in FIG. 12, the sliding sleeve 206 has no ports. Rather, the edge of the sleeve 206 is moved past the housing ports 204 to reach the open position. The inner sliding sleeve 206 is prevented from rotating in the valve housing 202 because it may become necessary to rotate the disconnect or activating tool (not shown) if it should become stuck.

In FIG. 11, a flexible latch ring 208 connected to the sliding sleeve 206 abuts an inner shoulder along a circumference of the valve housing 202. In order to open the valve, the sliding sleeve 206 must be pulled towards the ring 208 (to the right in FIG. 11) with sufficient force to compress the latch ring 208 radially. A corresponding shoulder is provided for keeping the sliding sleeve 206 in its open position by means of the same latch ring 208. Hence, the latch ring 208 prevents the sliding sleeve 206 from being swept along with fluid flowing in the central bore, and thus from being opened or closed unintentionally.

At the right hand side of FIG. 11, a support ring 210, a scraping ring 212 and a groove 214 for an opening-closing tool. The activating tool (not shown) is inserted into the pipe to move the sliding sleeve 206 between the closed and the open position.

The valve housing 202 and sliding sleeve 206 can each be provided with a label (216, 218), e.g. fixed permanent magnets. When the valve is closed, as shown in FIG. 11, the distance between the two labels/permanent magnets is less than when the valve is open. A difference between, for example 1 inch and 4 inches, between these labels or permanent magnets is relatively easy to detect, and can be used as an indication of whether the valve is open or closed.

Figure 12:
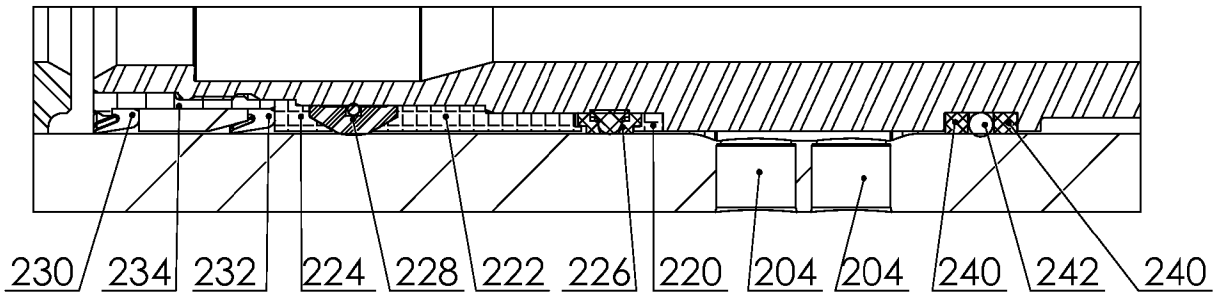
FIG. 12 is an enlarged view of the FIG. 11 valve section "B."

FIG. 12 is an enlarged view of the section marked "B" in FIG. 11. The mounting rings 220, 222, and 224 retain the seals 226 and 228. When the valve is opened by moving the sliding sleeve 206 to the right in FIGS. 11 and 12, the seal 226 will have passed the radial side ports 204 while the seal 228 still seals against the inner surface of the valve housing 202. The seal 228 may advantageously be manufactured from a stiffer material than the seal 226, and it is retained such that it is not torn out by the pressure difference across it when the seal 226 is on one side and the seal 228 is on the other side of the radial side ports 204.

The side ports 204 can be designed with different diameters for different purposes, e.g. with larger diameters for hydraulic fracturing than for production. The inner surfaces of the valve may also be hardened, e.g. for the purpose of hydraulic fracturing.

Figure 14:
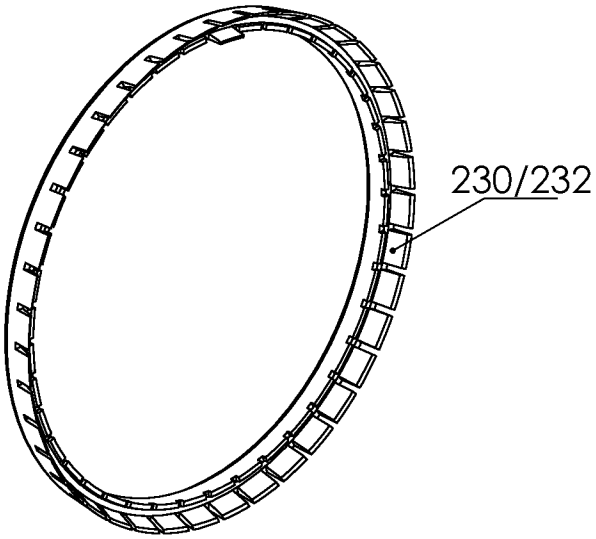
FIG. 14 depicts the scraping ring of FIG. 11.

Scraping rings 230 and 232 remove deposits and scaling from the inner surface of the valve housing 202 when the valve has been open for a period of time and is to be closed. An isometric view of scraping rings 230 and 232 is shown in FIG. 14, where it is apparent that the scraping rings 230 into 32 comprise scraping lobes separated by notches in the ring. The scraping rings 230 and 232 in FIG. 12 are both of the type shown in FIG. 14, but rotated relative to each other such that the lobes of ring 232 overlaps the notches on ring 230 and scrapes the parts of the valve housing 202 that are not scraped by the lobes on scraping ring 220.

The nut 234 is threaded to the sliding sleeve 206, and retains the parts 220, 222, 224, 226, 228, 230, and 232 described above. Support rings 240 retain a seal 242, sealing the valve opposite the side ports 204 relative to the seals 226 and 228, i.e. such that the side ports 204 are axially localized between the seals 226 and 242.

The side ports can be manufactured from a hard material, e.g. tungsten carbide, such that the valve withstands the wear from the ceramic balls used in hydraulic fracturing.

Figure 13:
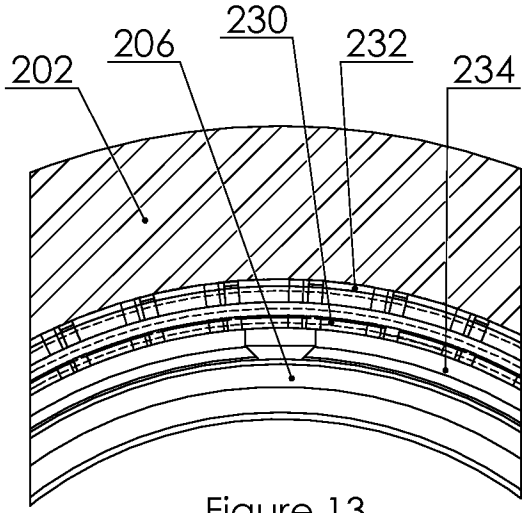
FIG. 13 is an enlarged view of the FIG. 11 valve section "C."

FIG. 13 shows a cross section of the valve through C-C on FIG. 11. The sliding sleeve 206 is slidably mounted in the valve housing 202, and overlapping scraping rings 230 and 232 are retained on the sliding sleeve 206 by the nut 234.

FIG. 14 shows a scraping ring 230 or 232 for mounting on the sliding sleeve 206 in order to scrape off deposits and the like to ensure sufficient sealing.

While the embodiments are described with reference to various implementations and exploitations, it will be understood that these embodiments are illustrative and that the scope of the inventive subject matter is not limited to them. Many variations, modifications, additions and improvements are possible.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A wellbore servicing system comprising:

a tubular assembly having a horizontal section disposed in a single production zone of a single formation, the tubular assembly including a first resealable valve and at least a second resealable valve disposed along the horizontal section of the tubular assembly uphole from the first resealable valve;

wherein the first resealable valve has a first profile and the second resealable valve has a second profile; and a shifting tool having a disconnect, the disconnect configured to:

set an internal packer at a first position within the tubular assembly, the first position being downhole from the first resealable valve;

after the internal packer is set at the first position, open and close the first resealable valve by engaging the first profile;

after the first resealable valve is closed, set the internal packer at a second position within the tubular assembly, the second position being uphole from the first resealable valve and downhold from the second resealable valve; and after the internal packer is set at the second position, open and close the second resealable valve by engaging the second profile.

2. The wellbore servicing system of claim 1 wherein the first resealable valve and the at least second resealable valve further comprise:

a substantially cylindrical outer valve housing including radially extending side ports and an inner sliding sleeve mounted axially movable and rotationally locked inside the valve housing;

the sliding sleeve further comprising a first seal, a second seal, and a third seal, which seals are all disposed around the entire circumference of the sliding sleeve and in contact with an inner sealing surface of the valve housing;

wherein the axial distance between the first and second seals is greater than the length of the valve housing comprising the side ports, and axial distance between the second and third seals is greater than the length of the valve housing comprising the side ports.

3. The wellbore servicing system of claim 2, wherein the first seal is made stiffer than the second and third seal.

4. The wellbore servicing system of claim 2, wherein the first seal is firmer retained than the second and third seal.

5. The wellbore servicing system of claim 2, wherein the sliding sleeve is fixed to a radially flexible latch ring abutting a first inner shoulder on the inner sealing surface of the valve housing when the valve is in a first, closed position, and abutting a second inner shoulder on the inner sealing surface of the valve housing when the valve is in a second, open position axially displaced from the first closed position; and the axial force required to move the sliding sleeve between its first and second positions must be sufficient to overcome a radially spring force from the latch ring.

6. The wellbore servicing system of claim 2 wherein the valve further comprises a scraping ring disposed between the sliding sleeve and the inner sealing surface of the valve housing.

7. The wellbore servicing system of claim 2 wherein the sliding sleeve comprises a first indicator;

the valve housing is firmly connected to a second indicator; and the axial distance between the first and second indicator indicates whether the sliding sleeve opens or closes for the radial side ports.

8. A wellbore servicing system comprising:

a tubular assembly having a first resealable valve and at least a second resealable valve disposed uphole from the first resealable valve; wherein the first resealable valve is configured to be selectively actuable between an open condition and a closed condition; further wherein the at least second resealable valve is configured to be selectively actuable between an open condition and a closed condition; and where the first resealable valve and the at least second resealable valve in the open condition allow a fluid to flow between an inner diameter of the tubular assembly and an outer diameter of the tubular assembly; and a shifting tool configured to set an internal packer at a position within the tubular assembly that is downhole from the first resealable valve.

9. The wellbore servicing system of claim 8 wherein the first resealable valve and the at least second resealable valve are each selectively actuable by hydraulic control lines.

10. The wellbore servicing system of claim 8 wherein the first resealable valve and the at least second resealable valve are each selectively actuable by an electric motor.

11. The wellbore servicing system of claim 8 wherein the first resealable valve and the at least second resealable valve further comprise:

a substantially cylindrical outer valve housing including radially extending side ports and an inner sliding sleeve mounted axially movable and rotationally locked inside the valve housing;

the sliding sleeve further comprising a first seal, a second seal, and a third seal, which seals are all disposed around the entire circumference of the sliding sleeve and in contact with an inner sealing surface of the valve housing;

wherein the axial distance between the first and second seals is greater than the length of the valve housing comprising the side ports, and axial distance between the second and third seals is greater than the length of the valve housing comprising the side ports.

12. The wellbore servicing system of claim 11, wherein the first seal is made stiffer than the second and third seal.

13. The wellbore servicing system of claim 11, wherein the first seal is firmer retained than the second and third seal.

14. The wellbore servicing system of claim 11, wherein the sliding sleeve is fixed to a radially flexible latch ring abutting a first inner shoulder on the inner sealing surface of the valve housing when the valve is in a first, closed position, and abutting a second inner shoulder on the inner sealing surface of the valve housing when the valve is in a second, open position axially displaced from the first closed position; and the axial force required to move the sliding sleeve between its first and second positions must be sufficient to overcome a radially spring force from the latch ring.

15. The wellbore servicing system of claim 11 wherein the valve further comprises a scraping ring disposed between the sliding sleeve and the inner sealing surface of the valve housing.

16. The wellbore servicing system of claim 11 wherein the sliding sleeve comprises a first indicator;

the valve housing is firmly connected to a second indicator; and the axial distance between the first and second indicator indicates whether the sliding sleeve opens or closes for the radial side ports.

17. A method of servicing a wellbore comprising:

running into a production zone of a single formation that includes at least a first and second formation zone, a tubular assembly having a horizontal section disposed in the production zone, the tubular assembly including a first resealable valve and an at least second resealable valve disposed within the horizontal section of the tubular assembly, the at least second reseal able valve being disposed uphole from the first resealable valve;

wherein the first resealable valve is configured to be selectively actuable between an open condition and a closed condition;

further wherein the at least second resealable valve is configured to be selectively actuable between an open condition and a closed condition; and where the first resealable valve and the at least second resealable valve in the open condition allow a fluid to flow between an inner diameter of the tubular assembly and an outer diameter of the tubular assembly;

setting an internal packer at a first position within the tubular assembly, the first position being downhole from the first resealable valve;

selectively actuating the first resealable valve from a closed condition to an open condition;

treating the first formation zone;

selectively actuating the first resealable valve from the open condition to the closed condition;

setting the internal packer at a second position within the tubular assembly, the second position being uphole from the first resealable valve;

selectively actuating the at least second resealable valve from a closed condition to an open condition;

treating the second formation zone; and selectively actuating the at least second resealable valve from the open condition to the closed position.

18. The method of servicing a wellbore of claim 17 wherein the first resealable valve are at least two resealable valves in a single isolated zone corresponding to the first formation zone.

19. The method of servicing a wellbore of claim 17 where anyone of the at least second resealable valves are at least two resealable valves in a single isolated zone corresponding to the second formation zone.

20. The wellbore servicing system of claim 17 wherein the first resealable valve and the at least second resealable valve are each selectively actuable by hydraulic control lines.

21. The wellbore servicing system of claim 17 wherein the first resealable valve and the at least second resealable valve are each selectively actuable by an electric motor.

22. The wellbore servicing system of claim 17 wherein the first resealable valve and the at least second resealable valve further comprise:

a substantially cylindrical outer valve housing including radially extending side ports and an inner sliding sleeve mounted axially movable and rotationally locked inside the valve housing;

the sliding sleeve further comprising a first seal, a second seal, and a third seal, which seals are all disposed around the entire circumference of the sliding sleeve and in contact with an inner sealing surface of the valve housing;

wherein the axial distance between the first and second seals is greater than the length of the valve housing comprising the side ports, and axial distance between the second and third seals is greater than the length of the valve housing comprising the side ports.

23. The wellbore servicing system of claim 22, wherein the first seal is made stiffer than the second and third seal.

24. The wellbore servicing system of claim 22, wherein the first seal is firmer retained than the second and third seal.

25. The wellbore servicing system of claim 22, wherein the sliding sleeve is fixed to a radially flexible latch ring abutting a first inner shoulder on the inner sealing surface of the valve housing when the valve is in a first, closed position, and abutting a second inner shoulder on the inner sealing surface of the valve housing when the valve is in a second, open position axially displaced from the first closed position; and the axial force required to move the sliding sleeve between its first and second positions must be sufficient to overcome a radially spring force from the latch ring.

26. The wellbore servicing system of claim 22 wherein the valve further comprises a scraping ring disposed between the sliding sleeve and the inner sealing surface of the valve housing.

27. The wellbore servicing system of claim 22 wherein the sliding sleeve comprises a first indicator;

the valve housing is firmly connected to a second indicator; and the axial distance between the first and second indicator indicates whether the sliding sleeve opens or closes for the radial side ports.

* * * * *